US006960125B2

(12) United States Patent
Mick

(10) Patent No.: US 6,960,125 B2
(45) Date of Patent: Nov. 1, 2005

(54) SANDING BLOCK

(76) Inventor: Jerry Mick, 531 Madison, Minneapolis, KS (US) 67467

( * ) Notice: Subject to any disclaimer, the term of this patent is extended or adjusted under 35 U.S.C. 154(b) by 0 days.

(21) Appl. No.: 10/702,394

(22) Filed: Nov. 3, 2003

(65) Prior Publication Data

US 2005/0095968 A1 May 5, 2005

(51) Int. Cl.[7] ..... B24B 15/00
(52) U.S. Cl. ..... 451/525; 451/512; 451/523; 451/524
(58) Field of Search ..... 451/513, 514, 451/575, 523, 524, 525, 512

(56) References Cited

U.S. PATENT DOCUMENTS

| | | | | |
|---|---|---|---|---|
| 1,562,414 | A | 11/1925 | McKnight | |
| 2,445,599 | A * | 7/1948 | Bowen | 451/503 |
| 2,485,295 | A | 10/1949 | Larson | |
| 2,626,490 | A * | 1/1953 | Meers | 451/503 |
| 2,765,593 | A | 10/1956 | Salmon et al. | |
| 2,904,939 | A * | 9/1959 | Raia | 451/491 |
| 3,849,949 | A | 11/1974 | Steinhauser et al. | |
| 3,912,142 | A | 10/1975 | Steinhauser et al. | |
| 5,662,519 | A * | 9/1997 | Arnold | 451/525 |
| 5,962,102 | A | 10/1999 | Sheffield et al. | |
| 6,062,966 | A | 5/2000 | Ali et al. | |
| 6,267,658 | B1 | 7/2001 | Ali et al. | |
| D462,597 | S | 9/2002 | Deshler et al. | |
| 6,494,771 | B2 | 12/2002 | Carlson | |
| 6,524,175 | B2 * | 2/2003 | Beaudry et al. | 451/524 |

* cited by examiner

*Primary Examiner*—Eileen P. Morgan
(74) *Attorney, Agent, or Firm*—Jeffrey L. Thompson; Thompson & Thompson, P.A.

(57) ABSTRACT

A sanding block for hand held use has a main body with a bottom side providing a surface for pressing a portion of a circular sheet of sandpaper against an article to be sanded. A first hook and loop-type fastener is secured to the top side of the main body for coupling with a corresponding material covering a backside of the sandpaper. A flap member is secured to the main body and is swingable between first and second positions. A second hook and loop-type fastener is secured to the flap member for coupling with the material covering the backside of the sandpaper. The flap member and the second fastener are arranged to pull the sheet of sandpaper taut across the bottom side when the flap member is moved from its first position to its second position. A closure system is provided for holding the flap member in its second position.

21 Claims, 9 Drawing Sheets

SANDING BLOCK

BACKGROUND OF THE INVENTION

1. Field of the Invention

The present invention relates generally to sanding devices. More particularly, the present invention relates to improvements in sanding blocks.

2. Description of the Related Art

Woodworking projects typically involve sanding of the wood before a finish is applied to the wood. Other surfaces, such as drywall and automotive bodies, are also commonly sanded before a finish is applied. Such sanding has been aided by use of power sanding devices, but almost invariably, some amount of hand sanding is generally needed in any quality sanding job.

Hand sanding has been performed using a variety of sanding blocks, sanding sticks, sanding pads, and individual pieces of sandpaper. The sanding process often must be carried out using multiple grades of abrasive to achieve a quality smooth surface that is free of sanding marks.

Early sanding blocks were simply blocks of solid material, such as wood, over which rectangular sheets of sandpaper were wrapped. While these devices were adequate for some purposes, they required some means of holding the ends of the sandpaper while applying one face of the block against the surface being sanded. This resulted in inefficient use of the sandpaper because the ends were generally never exposed to the surface being sanded. Various sanding blocks of this type employing means for grasping the ends of the abrasive sheet are disclosed, for example, in U.S. Pat. Nos. 2,765,593 and 1,562,414.

There has been developed and marketed a self-adhering sandpaper that uses a hook and loop adhesive system to adhere the sandpaper to a power sanding tool, such as a rotatable disc sander. The adhesive system normally includes a loop-type material covering a backside of the sandpaper, and a hook-type material covering a working surface of the sanding tool. Adhesive systems have also been developed in which a hook-type material covers the backside of the sandpaper, and a loop-type material covers the working surface of the sanding tool. Examples of such self-adhering sandpaper include sanding discs marketed by the 3M Company under the proprietary names, Hook-It and Hook-It II. However, when these self-adhering sandpapers are adhered directly to the working face of a sanding block, it is sometimes difficult to apply adequate pressure to the surface being sanded due to the cushion effect provided by the adhesive system, and it is also sometimes difficult to keep the edges of the sandpaper from becoming torn or crumpled during use.

Various other self-adhering sandpapers have also been developed that use pressure-sensitive coatings to adhere directly to the working face of a sanding block. This means of attaching sandpapers assures exposure of the entire abrasive face of the sandpaper. Such sandpapers are disclosed, for example, in U.S. Pat. Nos. 2,485,295, 3,849,949 and 3,912,142. This type of sandpaper has been used in conjunction with both rotatable disc sanders and hand held sanding blocks. However, once a piece of sandpaper with a pressure-sensitive coating is applied onto a block or sander, it cannot be readily changed until the sandpaper is ready to be disposed of because the sandpaper does not peel without tearing and will not re-stick. This makes changing back and forth between different grits of sandpaper difficult and costly.

Sanding blocks for hand sanding have not been developed to utilize self-adhering sandpaper to its fullest advantages. Thus, there is a need in the industry for an improved sanding block.

SUMMARY OF THE INVENTION

An object of the present invention is to provide an improved sanding block that overcomes the problems and shortcomings of the prior art.

A further object of the present invention is to provide a sanding block that can be used with standard size round sheets of sandpaper having loop-type material covering the back side thereof so the user does not have to cut sandpaper.

A further object of the present invention is to provide a sanding block for use with round sandpaper, which allows the sandpaper to be removed, rotated, and reapplied to use or consume the entire abrasive surface of the sandpaper.

A further object of the present invention is to provide a sanding block that allows the entire sheet of sandpaper to be used with minimal waste, that includes a simple structure for pulling and maintaining the sandpaper taut across the bottom side of the sanding block, that allows the sandpaper to be changed quickly and easily, and that is economical to manufacture and easy to use.

A further object of the present invention is to provide a sanding block having tapered ends that allow sanding closely up against another surface.

In order to accomplish these and other objects of the invention, a sanding block for hand held use is provided which has a main body with a bottom side providing a surface for pressing a circular sheet of sandpaper against an article to be sanded. A first hook-type fastener is secured to the top side of the main body for coupling with a corresponding loop-type material covering a backside of the sandpaper. A flap member is secured to the main body and is swingable between a first position in which the flap member protrudes outwardly from the main body, and a second position in which the flap member is folded flat against the top side of the main body. A second hook-type fastener is secured to the flap member for coupling with the loop-type material covering the backside of the sandpaper. The flap member and the second hook-type fastener are arranged to pull the sheet of sandpaper taut across the bottom side when the flap member is moved from its first position to its second position. A closure system is provided for holding the flap member in its second position to maintain the sanding block ready for sanding.

According to a broad aspect of the present invention, a sanding block is provided, comprising: a main body having a bottom surface for pressing a sheet of sandpaper against an article to be sanded; a first fastener structure secured to the main body for coupling with a backside of the sheet of sandpaper; a flap member secured to the main body and swingable between a first position in which the flap member protrudes outwardly from the main body and a second position in which the flap member is folded flat against the main body; and a second fastener structure secured to the flap member for coupling with the backside of the sandpaper. The first and second fastener structures and the flap member are arranged such that the sheet of sandpaper can be pulled taut across the bottom surface of the main body by moving the flap member from the first position to the second position with the sheet of sandpaper fastened to the first and second fastener structures.

According to another aspect of the present invention, a sanding block for hand held use is provided, comprising: a block member having top and bottom sides, front and back sides, and right and left sides, the bottom side providing a surface for pressing a first portion of a circular sheet of sandpaper against an article to be sanded; a first hook-type fastener means secured to the top side of the block member for coupling with a corresponding loop-type material covering a backside of a second portion of the circular sheet of sandpaper; a flap member secured to the block member and swingable about an axis between first and second positions; and a second hook-type fastener means secured to the flap member for coupling with a corresponding loop-type material covering a backside of a third portion of the circular sheet of sandpaper.

Numerous other objects of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figure 1:
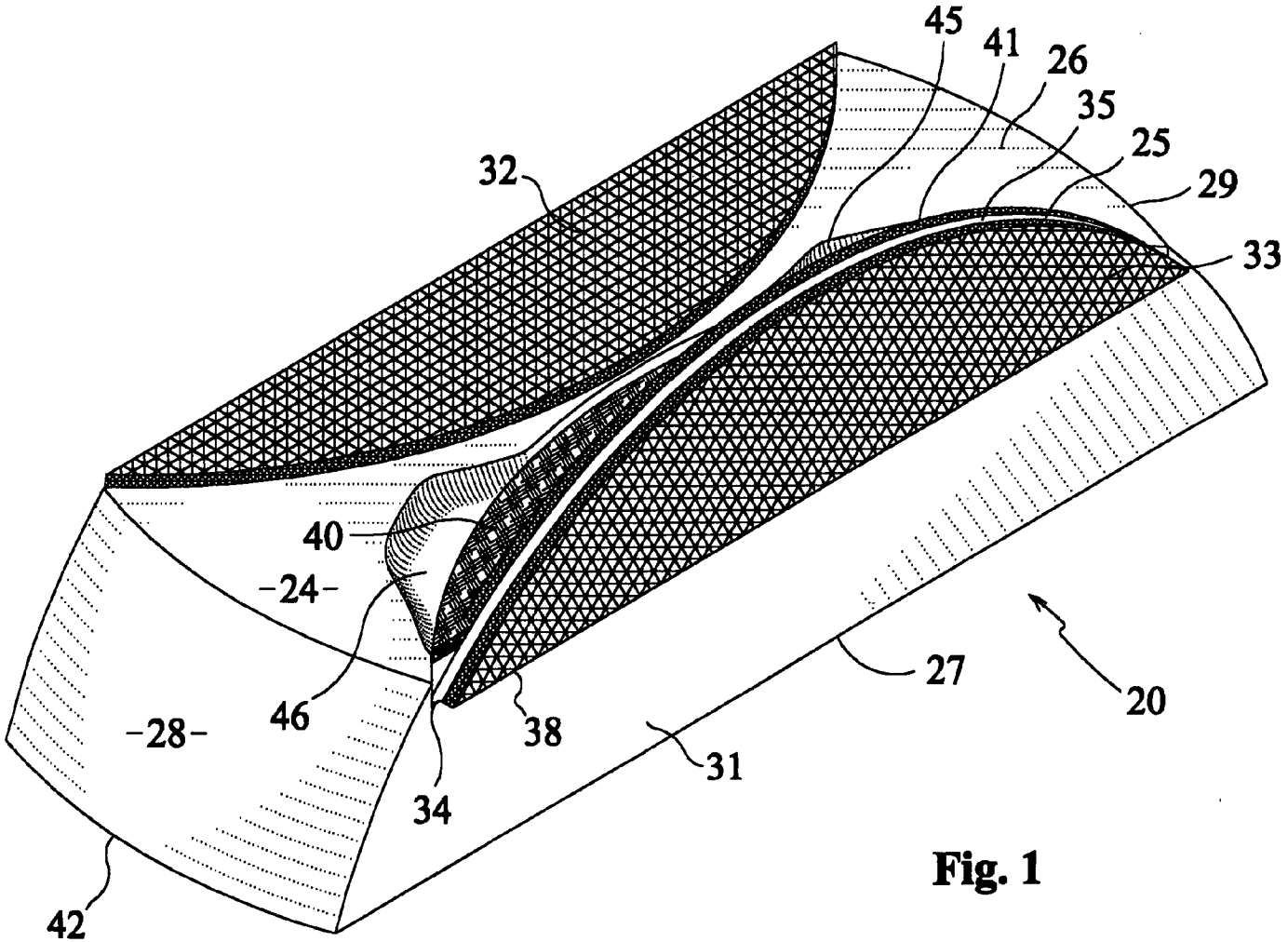
FIG. 1 is a perspective view of a sanding block according to the present invention.
Figure 2:
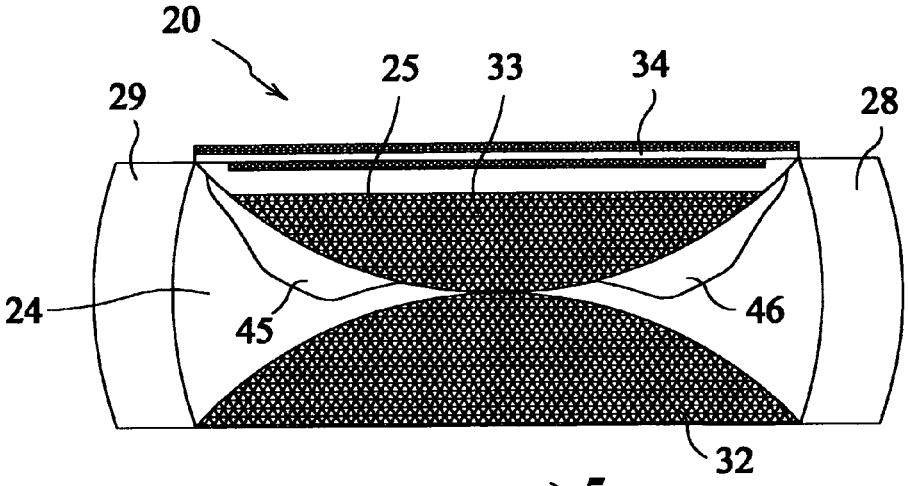
FIG. 2 is a top view of the sanding block.
Figure 3:
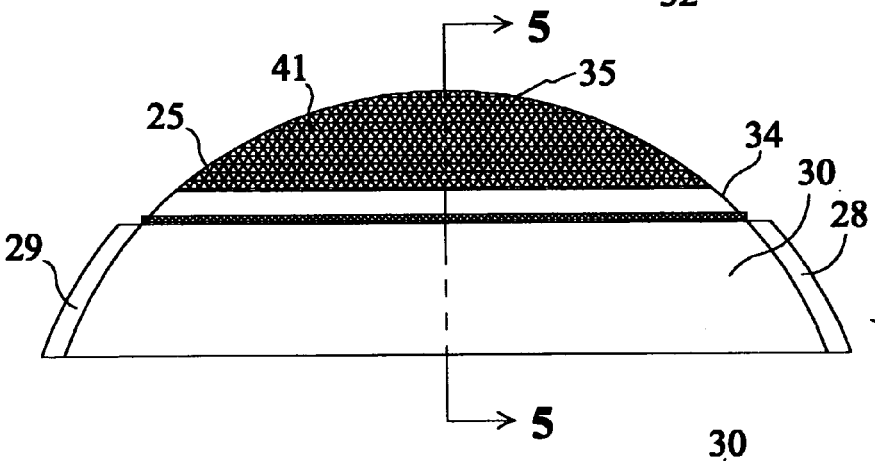
FIG. 3 is a side view of the sanding block.
Figure 4:
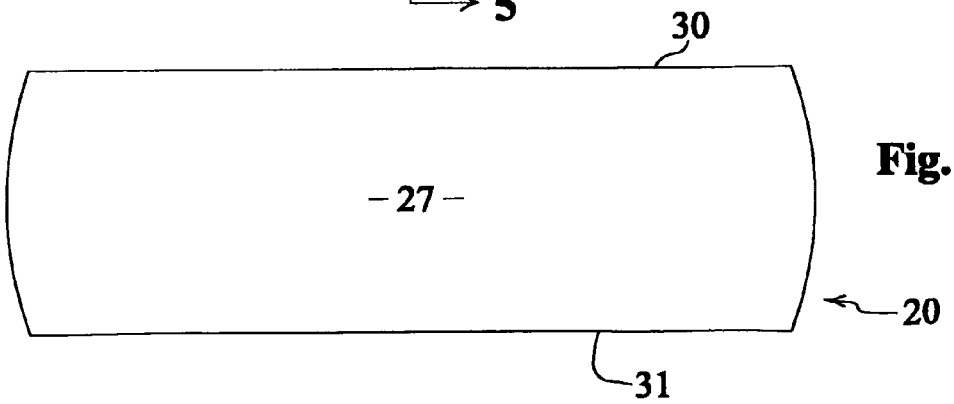
FIG. 4 is a bottom view of the sanding block.
Figure 5:
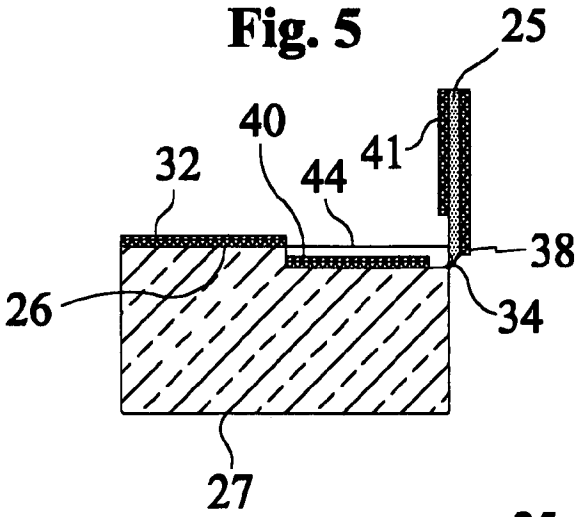
FIG. 5 is a cross section view of the sanding block taken along lines 5—5 in FIG. 3.

A sanding block 20 according to a preferred embodiment of the present invention will now be described with reference to FIGS. 1 to 14 of the accompanying drawings.

The sanding block 20 according to the present invention is made for hand held use with a conventional round sheet of sandpaper 21 having a first side covered by an abrasive material 22 and a second side covered by a first component 23 of a fastening system, such as a loop-type or hook-type fastening material. Such sandpaper 21 is commercially available, for example, from the 3M Company under the proprietary names, "Hook-It" and "Hook-It II" sandpaper, and is generically referred to in this application as non-holed hook and loop-type sandpaper. In the preferred embodiment, a six-inch (6") diameter sheet of sandpaper 21 is used. Other sizes of sandpaper 21 can be used to suit a particular application without departing from the present invention.

The sanding block 20 has a main body 24 and a flap member 25 secured to the main body 24. The main body 24 comprises a block member having top and bottom sides 26, 27, front and back sides 28, 29, and right and left sides 30, 31. The bottom side 27 has a hard bottom surface for pressing the sheet of sandpaper 21 against an article to be sanded (not shown). The hard bottom surface can be either smooth or textured to help keep the sandpaper 21 from sliding during use.

A first fastener structure 32, preferably a sheet of hook-type or loop-type fastening material, is secured to the top side 26 of the main body 24 for coupling with the loop-type or hook-type fastening material 23, respectively, on the backside of the sandpaper 21. The first fastener structure 32 has an arcuate shape corresponding to an outer section of the circular sheet of sandpaper 21.

A second fastener structure 33, which is also preferably a sheet of hook-type or loop-type fastening material, is secured to one side of the flap member 25 for coupling with the loop-type or hook-type fastening material 23, respectively, on the backside of the sandpaper 21. The second fastener structure 33 also has an arcuate shape corresponding to an outer section of the circular sheet of sandpaper 21.

The flap member 25 has a first edge 34 secured to the main body 24 at or adjacent to an intersection of the top side 26 with one of the right and left sides 30, 31. The flap member 25 has a second arc-shaped edge 35 that matches an outer circumference of the circular sheet of sandpaper 21. The arc-shaped edge 35 of the flap member 25 is substantially coextensive with an arcuate outer edge of the second fastener structure 33.

Figure 8:
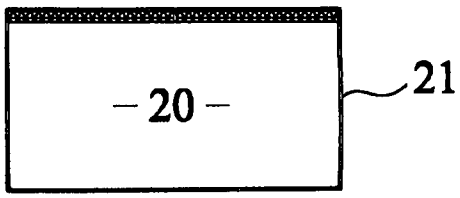
Figure 9:
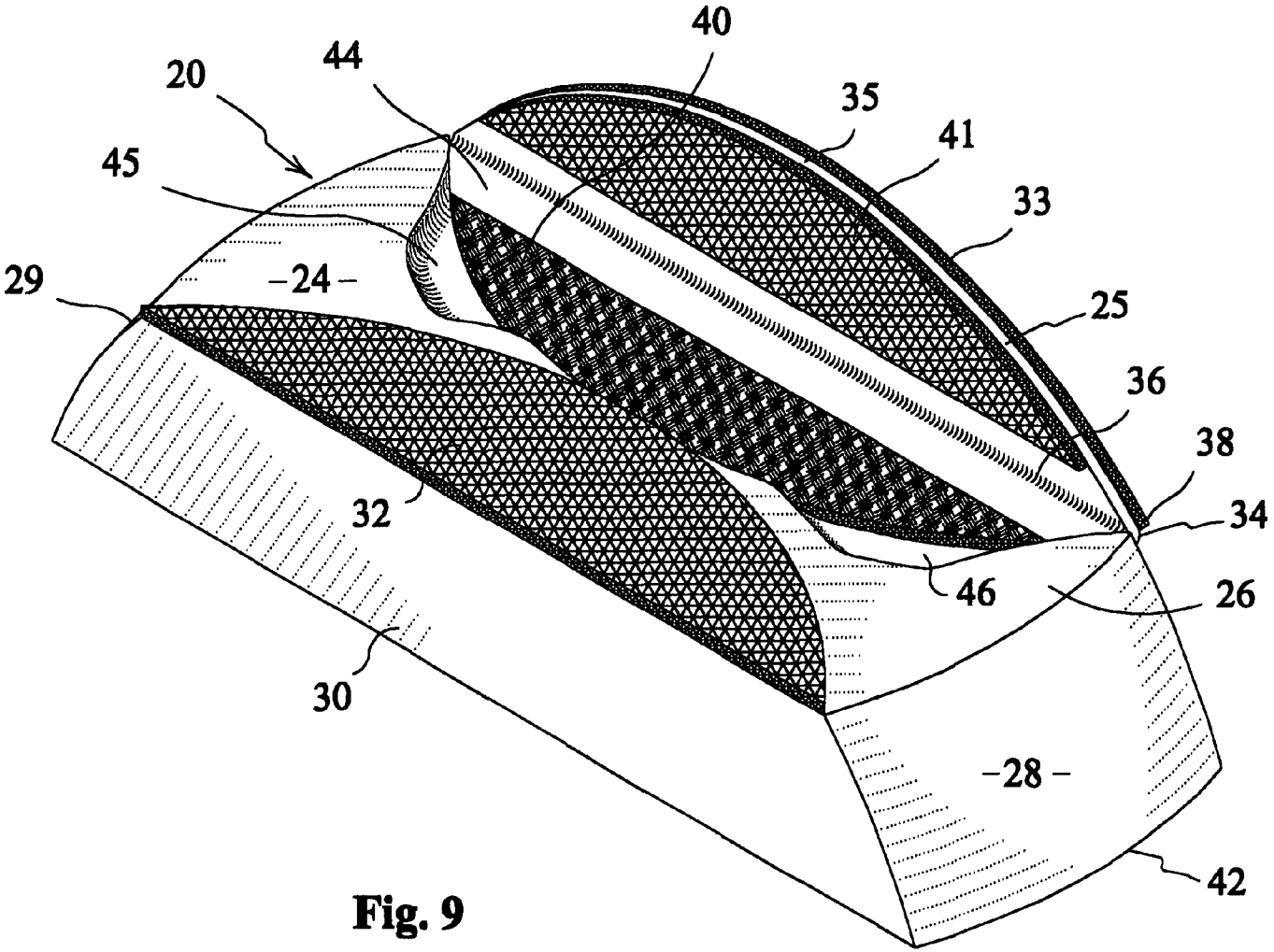
FIG. 9 is another perspective view of the sanding block according to the present invention.
Figure 13:
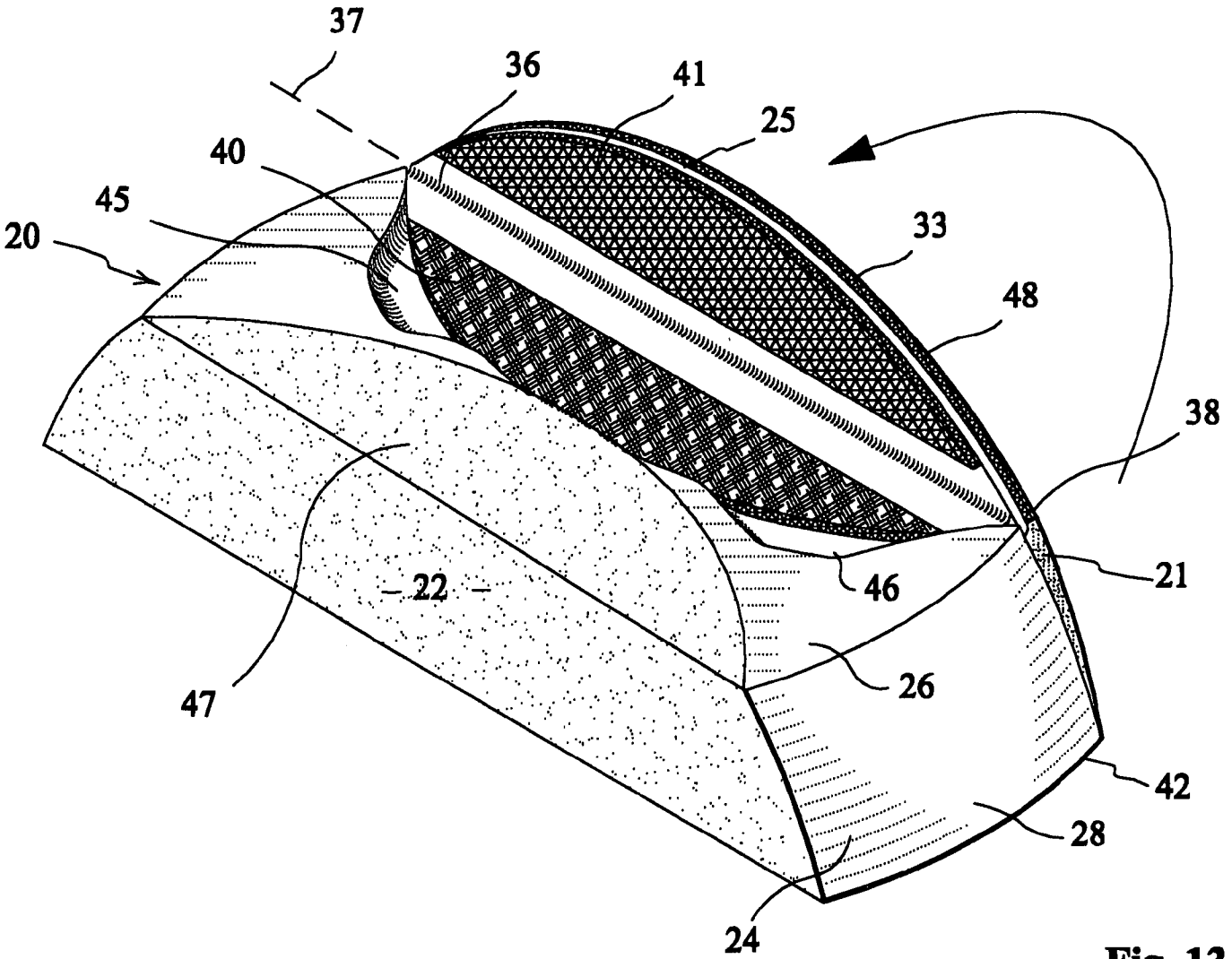
FIG. 13 is a perspective view showing a fourth step in the sequence of attaching the sandpaper to the sanding block.
Figure 14:
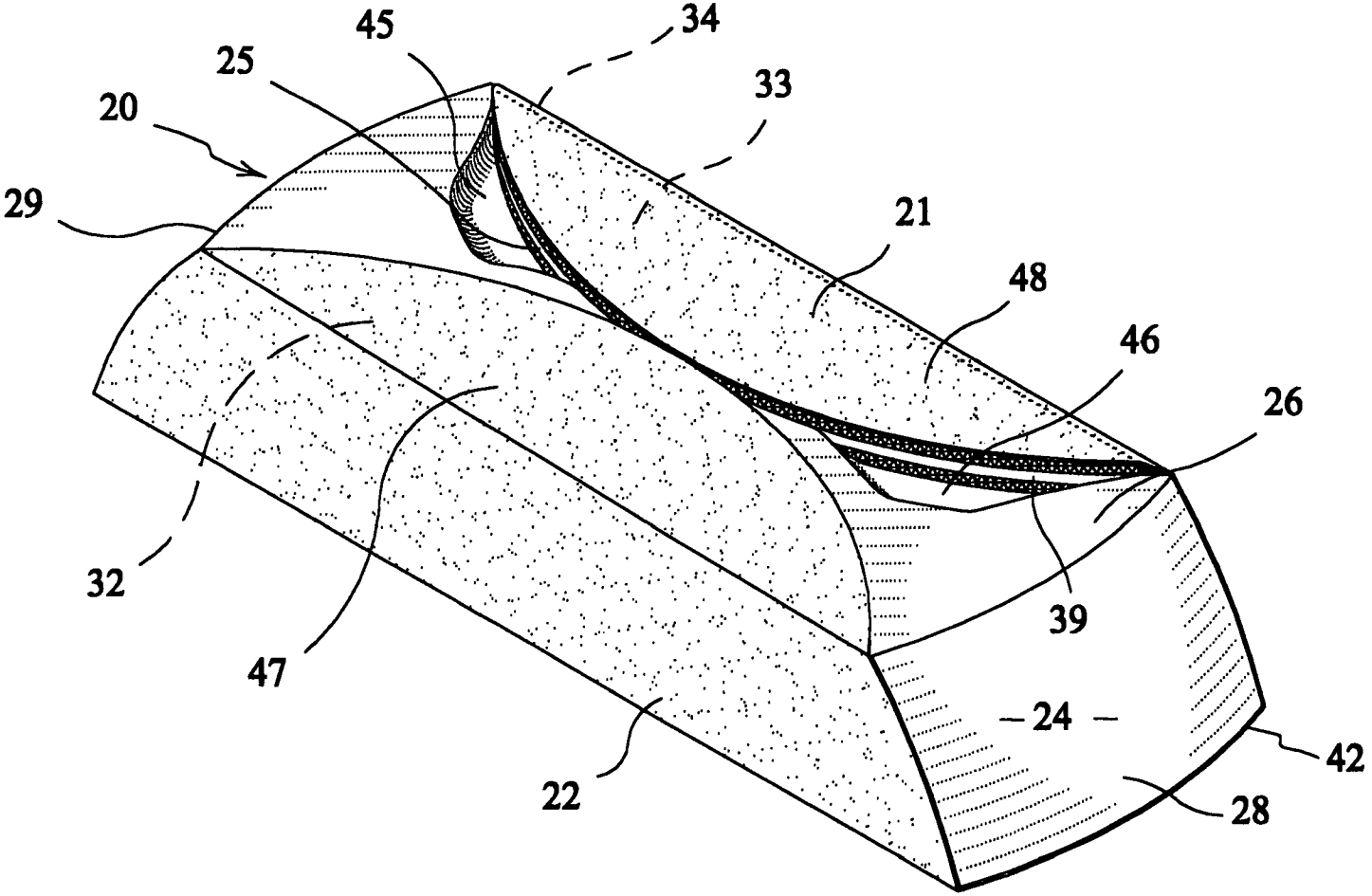
FIG. 14 is a perspective view showing a final step in the sequence of attaching the sandpaper to the sanding block.

The flap member 25 is secured to the main body 24 by a hinge structure 36, which makes the flap member 25 swingable about an axis 37 between a first position (shown in FIGS. 6 and 13) and a second position (shown in FIGS. 8 and 14). In the first position, the flap member 25 protrudes outwardly from the main body 24, while in the second position the flap member 25 is folded close to the main body 24. In the preferred embodiment, the flap member 25 is folded flat against the top side 26 of the main body 24 in its second position. The hinge structure 36 in the preferred embodiment is formed of bendable plastic integral with the first edge 34 of the flap member 25.

An inner side edge 38 of the second fastener structure 33 closest to the axis 37 of the flap member 25 is offset or spaced from the axis 37 and is thereby arranged to move further away from the bottom side 27 when the flap member 25 moves from its first position to its second position. As explained above and shown, for example, in FIGS. 6 and 13, the fastening material 23 covering the backside of the sheet of sandpaper 21 is secured on diametrically opposing sides of the circular shape of the sandpaper 21 to the first and second fastener structures 32, 33 on the sanding block 20. Thus, the swinging movement of the flap member 25 from its first position to its second position causes the sheet of sandpaper 21 to be pulled taut across the bottom surface of the main body 24.

A closure system 39 is provided for holding the flap member 25 in its second position. The closure system 39 preferably comprises a hook and loop-type fastener system having a first component 40 secured to the main body 24, and a second component 41 secured to the flap member 25. The first and second components 40, 41 of the closure system 39 are coupled together to hold the flap member 25 in its second position.

The front and back sides 28, 29 of the main body 24 of the sanding block 20 are disposed at an acute angle relative to the bottom side 27 to provide the sanding block 20 with at least one, and preferably two, tapered ends to facilitate sanding up against another surface. The lower edges 42 of the front and back sides 28, 29 are arc-shaped to match an outer circumference of the circular sheet of sandpaper 21.

The right and left sides 30, 31 of the main body 24 of the sanding block 20 are disposed at right angles relative to the bottom side 27 to provide convenient gripping surfaces for holding the sanding block 20. The edges 43 formed at the intersections of the right and left sides 30, 31 and the front and back sides 28, 29 of the main body 24 are arc-shaped to match the outer circumference of the circular sheet of sandpaper 21 when the sandpaper 21 is secured to the sanding block 20.

The arc-shaped edges 42, 43 of the sanding block 20 provide a symmetrical configuration that allows a round sheet of sandpaper 21 to be attached and used in any position of rotation. For example, the sandpaper 21 can be attached to the sanding block 20 and used in a first position, and then when the abrasive material 22 becomes worn, the sandpaper 21 can be removed, rotated and reattached to the sanding block 20 in a second position. In this manner, the abrasive material 22 on the entire sheet of sandpaper 21 can be used, and waste can be eliminated.

In the preferred embodiment, the main body 24 of the sanding block 20 has a recessed area 44 on its top side 26 for receiving the flap member 25 in its second position (FIGS. 8 and 14). The recessed area 44 allows the first and second fastener structures 32, 33 to be disposed in substantially the same plane on the top side 26 of the sanding block 20 when the flap member 25 is in its second position. Additional recesses 45, 46 are formed in the top side 26 of the main body 24 adjacent to the recessed area 44. The additional recesses 45, 46 provide access openings for gripping the arc-shaped edge 35 of the flap member 25 with a user's finger tip to facilitate moving the flap member 25 out of its second position.

The structure of the sanding block 20 according to a preferred embodiment of the present invention is described above. A sequence of attaching the circular sheet of sandpaper 21 to the sanding block 20 will now be described with reference to FIGS. 6 to 8 and 10 to 14.

Figure 10:
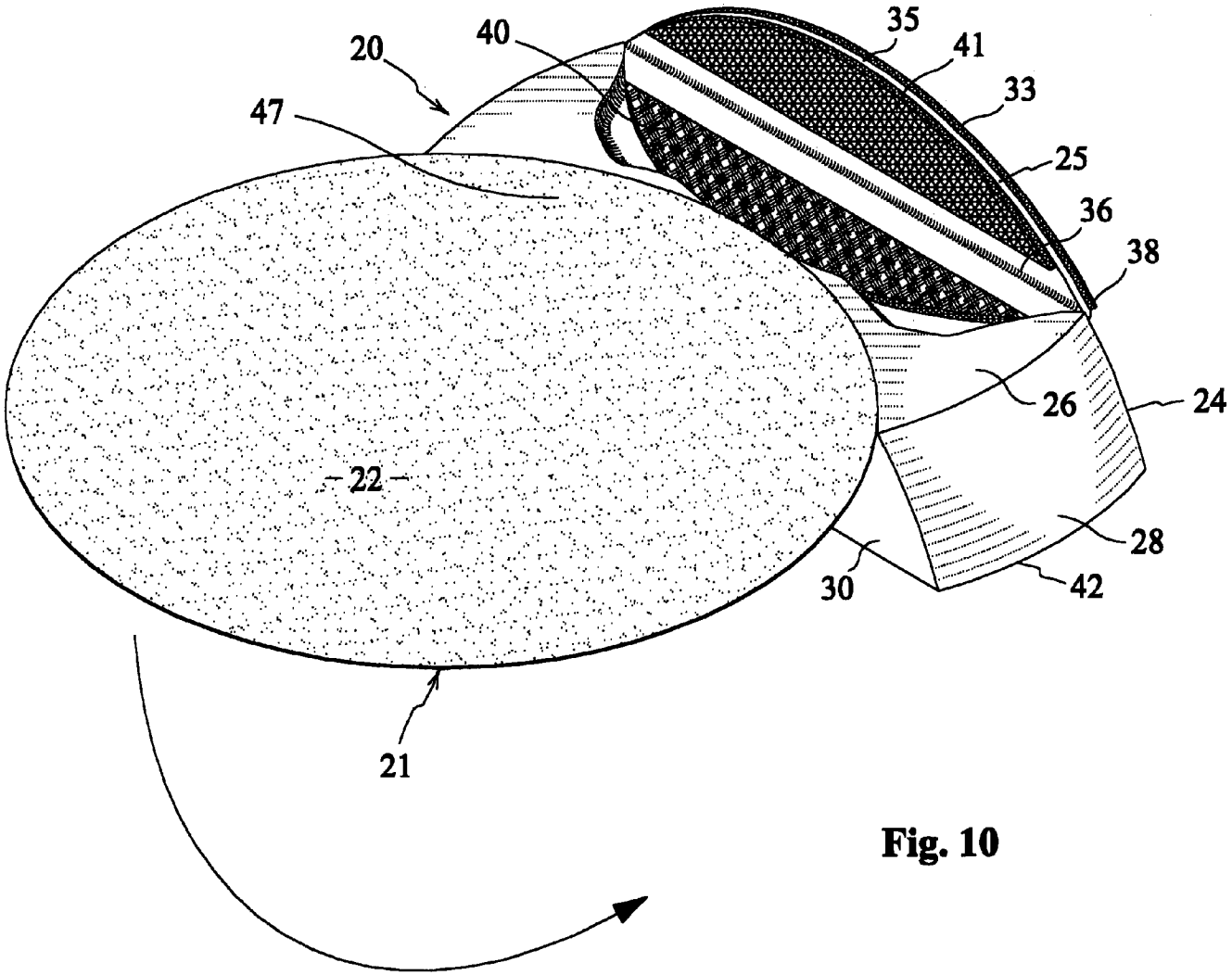
FIG. 10 is a perspective view similar to FIG. 9 showing a first step in the sequence of attaching a circular sheet of sandpaper to the sanding block.
Figure 11:
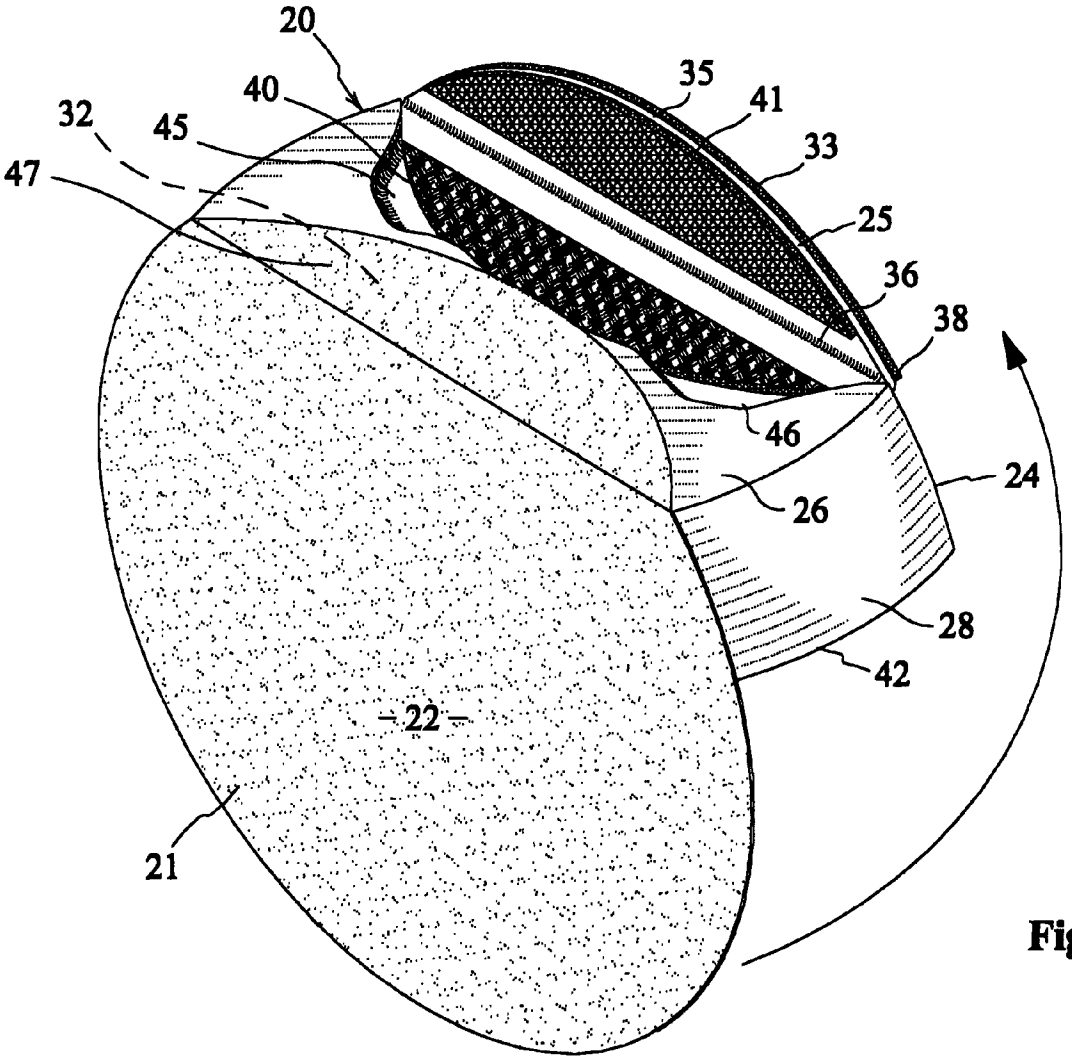
FIG. 11 is a perspective view showing a second step in the sequence of attaching the sandpaper to the sanding block.
Figure 12:
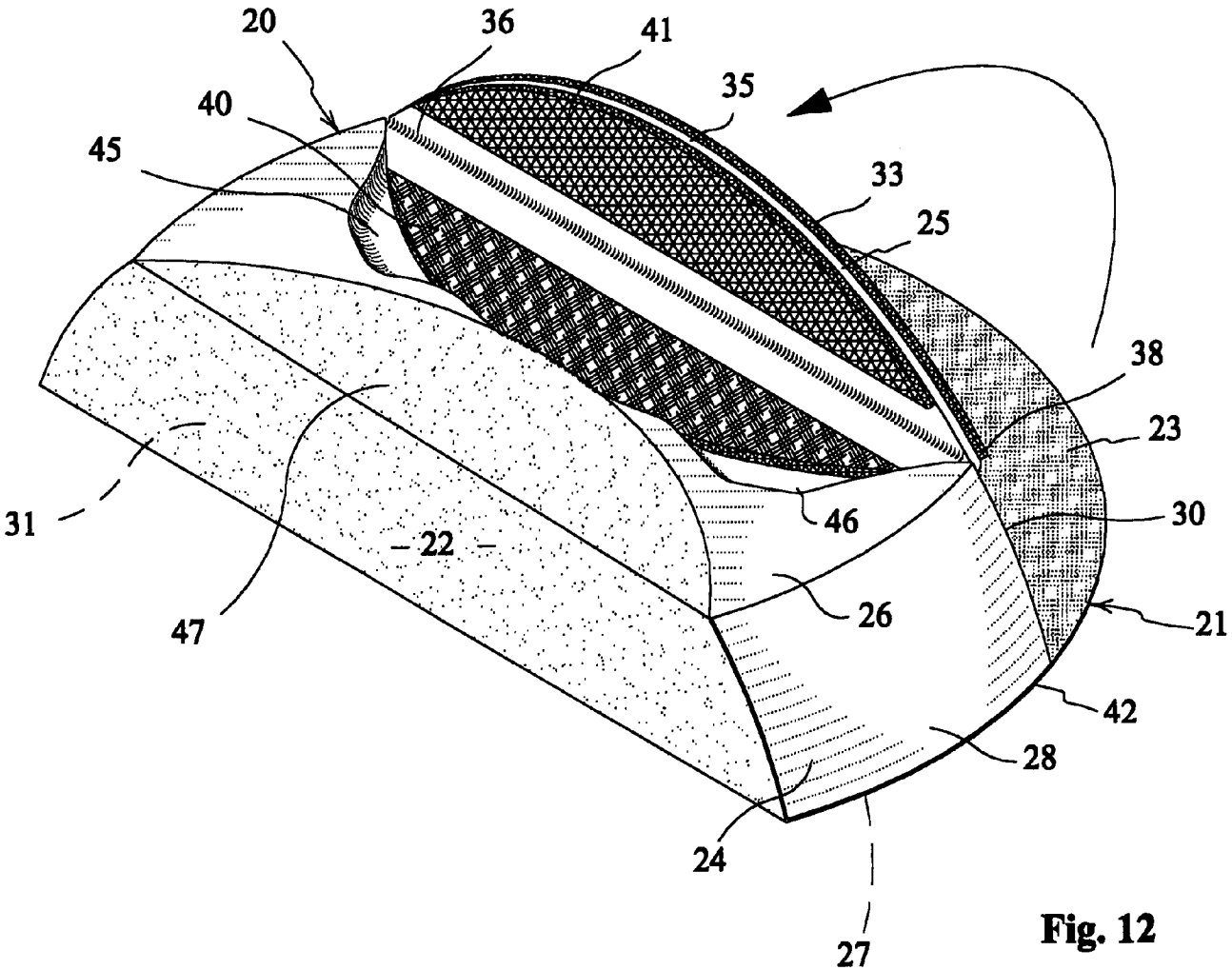
FIG. 12 is a perspective view showing a third step in the sequence of attaching the sandpaper to the sanding block.

The attachment sequence begins by attaching a first section 47 of the sandpaper 21 to the first fastener structure 32, as shown in FIG. 10. The arc-shaped edge of the first fastener structure 32 corresponds with the shape of the outer edge of the sandpaper 21. The sandpaper 21 is then folded along a left edge of the top side 26 of the sanding block 20 to cover the left side 31 of the main body 24, as shown in FIG. 11. The sandpaper 21 is then folded along a bottom edge between the left side 31 and bottom side 27 of the sanding block 20 until the sandpaper 21 covers the bottom side 27, as shown in FIG. 12.

Figure 6:
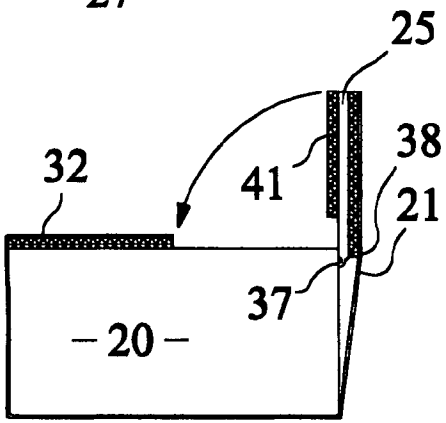
FIGS. 6, 7 and 8 are end views of the sanding block showing a sequence of attaching a circular sheet of sandpaper to the sanding block.

The sandpaper 21 is then folded along a bottom edge between the bottom side 27 and the right side 30 of the sanding block 20 until the sandpaper 21 covers the right side 30, as shown in FIG. 13. The flap member 25 is shown in FIG. 13 in its first position protruding outwardly from the main body 24 of the sanding block 20. A second section 48 of the sandpaper 21 opposite from the first section 47 is then attached to the second fastener structure 33 on the flap member 25, as shown in FIGS. 6 and 13. The arc-shaped edges of the second fastener structure 33 and the flap member 25 correspond with the shape of the outer edge of the sandpaper 21.

Figure 7:
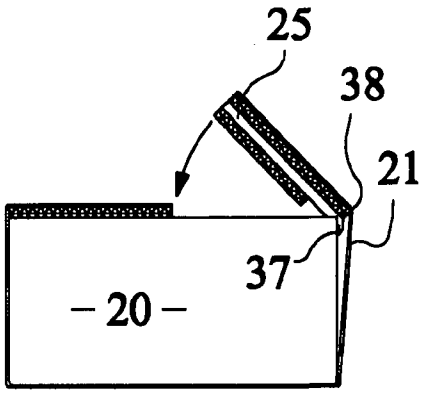

The flap member 25 is then moved from its first position shown in FIGS. 6 and 13, past an intermediate position shown in FIG. 7, to its second position shown in FIGS. 8 and 14. Since the inner side edge 38 of the second fastener structure 33 is offset from the axis 37 of rotation of the flap member 25, the movement of the flap member 25 from its first position to its second position causes the sandpaper 21 to be stretched between the first and second fastener structures 32, 33. As a result, the sandpaper 21 is pulled taut across the bottom side 27 of the sanding block 20, and the sanding block 20 is then ready for use.

Once the round sheet of sandpaper 21 becomes worn, the sandpaper 21 can be easily removed by moving the flap member 25 from its second position back to its first position, and then removing the sandpaper 21 from the first and second fastener structures 32, 33. The sandpaper 21 can then be rotated and reattached using the same attachment sequence described above. In this manner, the entire sheet of sandpaper 21 can be effectively used, and waste can be minimized.

It will be appreciated that certain features of the present invention described above can be changed without departing from the scope of the invention. For example, the main body 24 of the sanding block 20 can be made from a variety of materials, including wood, molded plastic, metal, and so forth. The main body 24 can also be made of a single molded or machined piece or multiple pieces fabricated together to achieve the desired shape. The closure system 39 used to hold the flap member 25 in its second position is not limited to a hook and loop type fastener. For example, the closure system 39 can be a magnetic or other type of clasp. The hinge 36 of the flap member 25 is not limited to bendable plastic as in the preferred embodiment. Instead, the hinge 36 can be made of flexible fabric or formed as separate hinge components that pivot relative to each other about a hinge pin or other suitable pivot mechanism.

While the invention has been specifically described in connection with specific embodiments thereof, it is to be understood that this is by way of illustration and not of limitation, and the scope of the appended claims should be construed as broadly as the prior art will permit.

What is claimed is:

1. A sanding block, comprising:

a main body having a bottom surface for pressing a front side of a sheet of sandpaper against an article to be sanded;

a first fastener structure secured to the main body for coupling with a backside of the sheet of sandpaper without destroying any part of the sheet of sandpaper;

a flap member secured to the main body and swingable between a first position in which the flap member protrudes outwardly from the main body and a second position in which the flap member is folded flat against the main body; and a second fastener structure secured to the flap member for coupling with the backside of the sandpaper when said flap member is in said first position without destroying any part of the sheet of sandpaper, said first and second fastener structures and said flap member being arranged such that the sheet of sandpaper can be pulled taut across the bottom surface of the main body by moving said flap member from said first position to said second position with the sheet of sandpaper fastened to the first and second fastener structures; wherein the front side of the sandpaper facing away from the first fastener structure does not engage the front side of the sandpaper facing away from the second fastener structure when said flap is in the second position.

2. The sanding block according to claim 1, wherein said first and second fastener structures are hook-type or loop-type fasteners for coupling with a corresponding loop-type or hook-type material covering the backside of the sheet of sandpaper.

3. The sanding block according to claim 1, further comprising a closure system for holding said flap member in said second position.

4. The sanding block according to claim 3, wherein said closure system comprises a hook and loop type fastener system having a first component secured to said main body and a second component secured to said flap member, said first component being coupled with said second component to hold said flap member in said second position.

5. The sanding block according to claim 1, wherein said first fastener structure comprises a sheet of hook-type or loop-type material secured to the main body for coupling with a loop-type or hook-type material, respectively, covering a backside of the sheet of sandpaper, and said first fastener structure has an arcuate shape corresponding to an outer section of a circular sheet of sandpaper.

6. The sanding block according to claim 1, wherein said second fastener structure comprises a sheet of hook-type or loop-type material secured to the flap member for coupling with a loop-type or hook-type material, respectively, covering a backside of the sheet of sandpaper, and said second fastener structure has an arcuate shape corresponding to an outer section of a circular sheet of sandpaper.

7. The sanding block according to claim 1, wherein said main body comprises top and bottom sides, front and back sides, and right and left sides, said bottom surface being disposed on said bottom side, said first fastener structure being disposed on said top side, and said flap member being folded flat against said top side in its said second position.

8. The sanding block according to claim 7, wherein at least one of said front and back sides are disposed at an acute angle relative to said bottom side to provide the sanding block with at least one tapered end which is not covered by sandpaper to facilitate sanding up against another surface using the portion of the sandpaper covering the bottom side of the sanding block.

9. The sanding block according to claim 7, wherein at least lower edges of said front and back sides are arc-shaped to match an outer circumference of a circular sheet of sandpaper.

10. The sanding block according to claim 7, wherein said right and left sides are disposed at right angles relative to said bottom side to provide convenient gripping surfaces for holding the sanding block, said right and left sides being arranged such that a sheet of sandpaper pulled taut across the bottom surface of the main body by the first and second fastener structures also covers said right and left sides and provides two additional sanding surfaces.

11. The sanding block according to claim 7, wherein said flap member has a first edge coupled to said main body at or adjacent to an intersection of the top side with one of the right and left sides.

12. The sanding block according to claim 11, wherein said flap member has a second arc-shaped edge to match an outer circumference of a circular sheet of sandpaper.

13. The sanding block according to claim 1, wherein said flap member is swingable about an axis between said first and second positions, and wherein a side edge of said second fastener structure closest to said axis is spaced from said axis and said side edge is arranged to move relative to said bottom surface when said flap member moves from its first position to its second position to thereby pull the sandpaper taut across the bottom surface.

14. The sanding block according to claim 1, wherein said main body comprises top and bottom sides, and said top side has at least one recess formed therein adjacent to an edge of said flap member when said flap member is in its said second position, said recess facilitating gripping and moving said flap member out of its said second position.

15. In combination, a sanding block and sandpaper for use with the sanding block, said sandpaper comprising:

a round sheet having a first side covered by an abrasive material and a second side covered by a loop-type or hook-type fastening material;

said sanding block comprising:

a main body having a bottom surface for pressing the sandpaper against an article to be sanded;

a first fastener structure secured to a surface of the main body other than the bottom surface for coupling with the fastening material on the sandpaper;

a flap member secured to the main body and swingable between a first position in which the flap member protrudes outwardly from the main body and a second position in which the flap member is folded close to the main body; and a second fastener structure secured to the flap member for coupling with the fastening material on the sandpaper, said first and second fastener structures and said flap member being arranged such that the round sheet of sandpaper can be pulled taut across the bottom surface of the main body by coupling the fastening material on diametrically opposing sides of the round sheet of sandpaper with the first and second fastener structures, respectively, and then moving said flap member from said first position to said second position; wherein the first side of the sandpaper facing away from the first fastener structure does not engage the first side of the sandpaper facing away from the second fastener structure when said flap is in the second position.

16. The combination according to claim 15, wherein said sanding block further comprises a closure system for holding said flap member in said second position.

17. The combination according to claim 15, wherein said flap member is swingable about an axis between said first and second positions, and wherein a side edge of said second fastener structure closest to said axis is spaced from said axis and said side edge is arranged to move relative to said bottom surface when said flap member is moved from its first position to its second position to thereby pull the sandpaper taut across the bottom surface.

18. The combination according to claim 15, wherein said sanding block is constructed and arranged such that said round sheet of sandpaper can be removed, rotated and reattached to the sanding block to use the entire sheet of sandpaper.

19. A sanding block for hand held use, comprising:

a block member having top and bottom sides, front and back sides, and right and left sides, said bottom side providing a surface for pressing a first portion of a front side of a circular sheet of sandpaper against an article to be sanded;

a first book-type or loop-type fastener means secured to the top side of the block member for coupling with a corresponding loop-type or hook-type material, respectively, covering a backside of a second portion of the circular sheet of sandpaper;

a flap member secured to the block member and swingable about an axis between first and second positions; and a second hook-type or loop-type fastener means secured to the flap member far coupling with a corresponding loop-type or hook-type material, respectively, covering a backside of a third portion of the circular sheet of sandpaper, said second and third portions of the circular sheet of sandpaper being diametrically opposed from each other, and said flag member and said first and second fastener means being arranged to pull the circular sheet of sandpaper taut across the bottom side of the block member when said flap member is moved from its first position to its second position; wherein the front side of the sandpaper facing away from the backside of the second portion does not engage the front side of the sandpaper facing away from the backside of the third portion when said flap is in the second position.

20. The sanding block according to claim 19, wherein an edge of said second fastener means closest to said axis is offset from said axis and is arranged to move relative to the bottom side of the block member when said flap member is moved from its first position to its second position to thereby pull the sandpaper taut across the bottom side.

21. The sanding block according to claim 19, further comprising a hook and loop type closure system for holding said flap member in said second position.

* * * * *